US010823487B2

(12) United States Patent
Fei et al.

(10) Patent No.: US 10,823,487 B2
(45) Date of Patent: Nov. 3, 2020

(54) REFRIGERATOR AND SHELF THEREOF

(71) Applicant: QINGDAO HAIER CO., LTD., Qingdao, Shandong Province (CN)

(72) Inventors: Bin Fei, Qingdao (CN); Yazhou Shang, Qingdao (CN); Dengqiang Li, Qingdao (CN); Falin Yang, Qingdao (CN); Guangrui Wu, Qingdao (CN)

(73) Assignee: QINGDAO HAIER CO., LTD., Qingdao, Shandong Province (CN)

( * ) Notice: Subject to any disclaimer, the term of this patent is extended or adjusted under 35 U.S.C. 154(b) by 0 days.

(21) Appl. No.: 16/626,874

(22) PCT Filed: Dec. 20, 2018

(86) PCT No.: PCT/CN2018/122301
§ 371 (c)(1),
(2) Date: Dec. 26, 2019

(87) PCT Pub. No.: WO2019/128833
PCT Pub. Date: Jul. 4, 2019

(65) Prior Publication Data

US 2020/0141631 A1 May 7, 2020

(30) Foreign Application Priority Data

Dec. 28, 2017 (CN) ..... 2017 1 1458232

(51) Int. Cl.
*A47B 96/04* (2006.01)
*F25D 23/06* (2006.01)
*A47B 96/02* (2006.01)

(52) U.S. Cl.
CPC ..... *F25D 23/067* (2013.01); *A47B 96/025* (2013.01); *F25D 2331/803* (2013.01); *F25D 2331/809* (2013.01)

(58) Field of Classification Search
CPC ..... A47B 96/025; F25D 2325/021; F25D 2331/803; F25D 2331/809; F25D 23/067;
(Continued)

(56) References Cited

U.S. PATENT DOCUMENTS 365,158 A * 6/1887 Van Duzer ..... A47C 20/027 160/368.2
514,890 A * 2/1894 Heilmann ..... E05D 11/1078 16/329
(Continued)

FOREIGN PATENT DOCUMENTS

CN 201050924 Y 4/2008
CN 201897359 U 7/2011
(Continued)

OTHER PUBLICATIONS

English translation of Qianyong (CN201050924) (Year: 2020).*

*Primary Examiner* — Matthew W Ing
(74) *Attorney, Agent, or Firm* — Cheng-Ju Chiang

(57) ABSTRACT

A shelf comprises a shelf plate and a rack connected to the shelf plate pivotally and rotating between a folded position adjacent to the shelf plate and an unfolded position apart from the shelf plate. The shelf further comprises a rotary assembly connected with the shelf plate and the rack and enabling the rack to have at least two unfolded positions, such that the angle and a height at which the rack is fixed may be regulated as required, thereby meeting requirements of placing the bottles and beverage bottles of different sizes, and increasing universality and flexibility of application of the shelf.

13 Claims, 2 Drawing Sheets

(58) Field of Classification Search
CPC ..... E05D 11/1078; Y10T 16/540254; Y10T 16/540255
See application file for complete search history.

(56) References Cited

U.S. PATENT DOCUMENTS

| | | | | | |
|---|---|---|---|---|---|
| 771,608 | A * | 10/1904 | Chaffee | E05D 11/1078 | 16/330 |
| 2,018,002 | A * | 10/1935 | Avery | F25D 25/021 | 211/74 |
| 6,074,030 | A * | 6/2000 | Prunty | E05F 5/02 | 16/374 |
| 2003/0226237 | A1* | 12/2003 | Johnson | E05D 11/1085 | 16/300 |
| 2012/0030904 | A1* | 2/2012 | Duan | G06F 1/1681 | 16/251 |
| 2013/0175264 | A1* | 7/2013 | Lin | G06F 1/1681 | 220/4.22 |

FOREIGN PATENT DOCUMENTS

| | | | |
|---|---|---|---|
| CN | 202254616 | U | 5/2012 |
| CN | 202485321 | U | 10/2012 |
| CN | 202709627 | U | 1/2013 |
| CN | 202999968 | U | 6/2013 |
| CN | 103201573 | A | 7/2013 |
| CN | 103542680 | A | 1/2014 |
| CN | 203810842 | U | 9/2014 |
| CN | 204232578 | U | 4/2015 |
| CN | 106679317 | A | 5/2017 |
| CN | 106839631 | A | 6/2017 |
| CN | 108332501 | A | 7/2018 |
| DE | 202004001240 | U1 | 6/2005 |
| EP | 2090855 | A1 | 8/2009 |
| EP | 2840337 | A1 | 2/2015 |
| KR | 2000-0074255 | A | 12/2000 |
| KR | 10-2015-0059837 | A | 6/2015 |
| WO | 2015/185093 | A1 | 12/2015 |

* cited by examiner

REFRIGERATOR AND SHELF THEREOF

The present application is a 35 U.S.C. § 371 National Phase conversion of International (PCT) Patent Application No. PCT/CN2018/122301, filed on Dec. 20, 2018, which claims priority to Chinese Patent Application No. 201711458232.1, filed on Dec. 28, 2017 and titled "REFRIGERATOR AND SHELF THEREOF", which is incorporated herein by reference in its entirety. The PCT International Patent Application was filed and published in Chinese.

TECHNICAL FIELD

The invention relates to a refrigerator and shelf thereof, and belongs to the field of refrigeration equipment.

BACKGROUND

When a container, such as a wine bottle, is refrigerated in a refrigerator, due to influences of an internal structure of the refrigerator and a size of the wine bottle, a fixed space for storing the container, such as the wine bottle, is not available in a refrigerating space of the refrigerator, such that the wine bottle is prone to roll or fall in the refrigerator; an independent wine rack takes up most of a storage space of the refrigerator when placed in the refrigerator.

The existing wine rack in the refrigerator on the market is mostly separated from a glass shelf, and there is also a rollover wine rack combined with the glass shelf.

Although a structure in which the wine rack is separated from the glass shelf has a function of placing the container, such as the wine bottle, when a user does not place such an article, the wine rack is redundant and occupies the space; although the existing rollover wine rack combined with the glass shelf on the market may solve the problem of space usage when the container, such as the wine bottle, is not placed, at a rollover position of the wine rack, the front and rear wine racks are fixed at a single angle and have a fixed distance therebetween, and the user is unable to make a proper adjustment based on the size and a thickness of the wine bottle required to be placed; in addition, the front and rear wine racks have the same height, and the wine bottle has a thick bottle body and a thin bottleneck, such that the bottleneck is oblique downwards after the wine bottle is placed, and the problems, such as wine leakage, or the like, may be caused after long-term placement.

In view of this, it is necessary to provide a new shelf and a refrigerator to solve the above-mentioned problems.

SUMMARY

An object of the present invention is to provide a new shelf provided with a wine rack, and with the shelf, a rollover angle of the wine rack may be regulated as required when in use, thereby solving the problems of a single fixed position and inconvenient storage of a wine bottle.

In order to achieve the above-mentioned object, the present invention adopts the following technical solution: a shelf, comprises a shelf plate and a wine rack connected to the shelf plate pivotally and rotating between a folded position close to the shelf plate and an unfolded position apart from the shelf plate, the shelf further comprises a rotary assembly connected with the shelf plate and the wine rack and enabling the wine rack to have at least two unfolded positions.

As a further improved technical solution of the present invention, the rotary assembly comprises a first regulating part connected with the shelf plate and a second regulating part connected with the wine rack, the first and second regulating parts are connected rotatably relative to each other around a pivotal shaft, and the folded position and the at least two unfolded positions are provided on one of the first and second regulating parts in a circumferential direction of the pivotal shaft.

As a further improved technical solution of the present invention, the rotary assembly further comprises a concave-convex engagement structure comprising a first curved surface formed on the first regulating part and a second curved surface formed on the second regulating part, and when the first and second regulating parts are static relatively, the first curved surface abuts against the second curved surface; when the second regulating part rotates relative to the first regulating part, the second curved surface jumps to and fro in an axial direction of the pivotal shaft by getting apart from and close to the first curved surface.

As a further improved technical solution of the present invention, one of the first and second curved surfaces is provided thereon with a groove and/or a projection, and the other of the first and second curved surfaces is provided thereon with a projection engaged with the groove and/or a groove engaged with the projection.

As a further improved technical solution of the present invention, the groove and the projection which are provided adjacently on the first curved surface and/or the second curved surface are connected smoothly to form a corrugated surface, N corrugated surfaces are provided on the first curved surface and/or the second curved surface, and N is not less than three.

As a further improved technical solution of the present invention, the rotary assembly further comprises a reset part provided on one side of the first or second regulating part, and when the second regulating part rotates relative to the first regulating part, the reset part drives one of the first and second regulating parts to restore to abut against the other of the first and second regulating parts, and the reset part and the pivotal shaft are provided on the same side of the first or second regulating part.

As a further improved technical solution of the present invention, the wine rack comprises a middle portion for laying a wine bottle and a connecting portion for connecting the middle portion to the shelf plate, the pivotal shaft is formed as a free end of the connecting portion, and the reset part is configured as the connecting portion which is bent and formed integrally relative to the middle portion.

As a further improved technical solution of the present invention, the second regulating part is provided with an open groove for receiving the free end, and further comprises a fixing part for sealing the open groove after the free end enters the open groove, so as to avoid the free end being separated from the open groove.

As a further improved technical solution of the present invention, the rotary assembly further comprises a stopper provided on one of the first and second regulating parts, and when rotating by a certain angle relative to the first regulating part, the second regulating part is blocked from rotating continuously by the stopper.

As a further improved technical solution of the present invention, the wine rack is provided thereon with an accommodating groove for receiving a liquid container, the accommodating groove has the same size as a bottle body or a bottle neck of the container, and the shelf comprises the two wine racks, the accommodating grooves of which have different sizes.

In order to achieve the above-mentioned object, the present invention further provides a refrigerator, comprising a cabinet, and the shelf above-mentioned is provided in the cabinet.

The present invention has such beneficial effects that compared with a prior art, the shelf according to the present invention has at least two unfolded positions, such that the angle and a height at which the wine rack is fixed may be regulated as required, thereby meeting requirements of placing the wine bottles and beverage bottles of different sizes, and increasing universality and flexibility of application of the shelf.

DETAILED DESCRIPTION

The present invention will be described below in detail in combination with specific embodiments illustrated in drawings. However, these embodiments have no limitations on the present invention, and any transformations of structure, method, or function made by persons skilled in the art according to these embodiments fall within the protection scope of the present invention.

Figure 1:
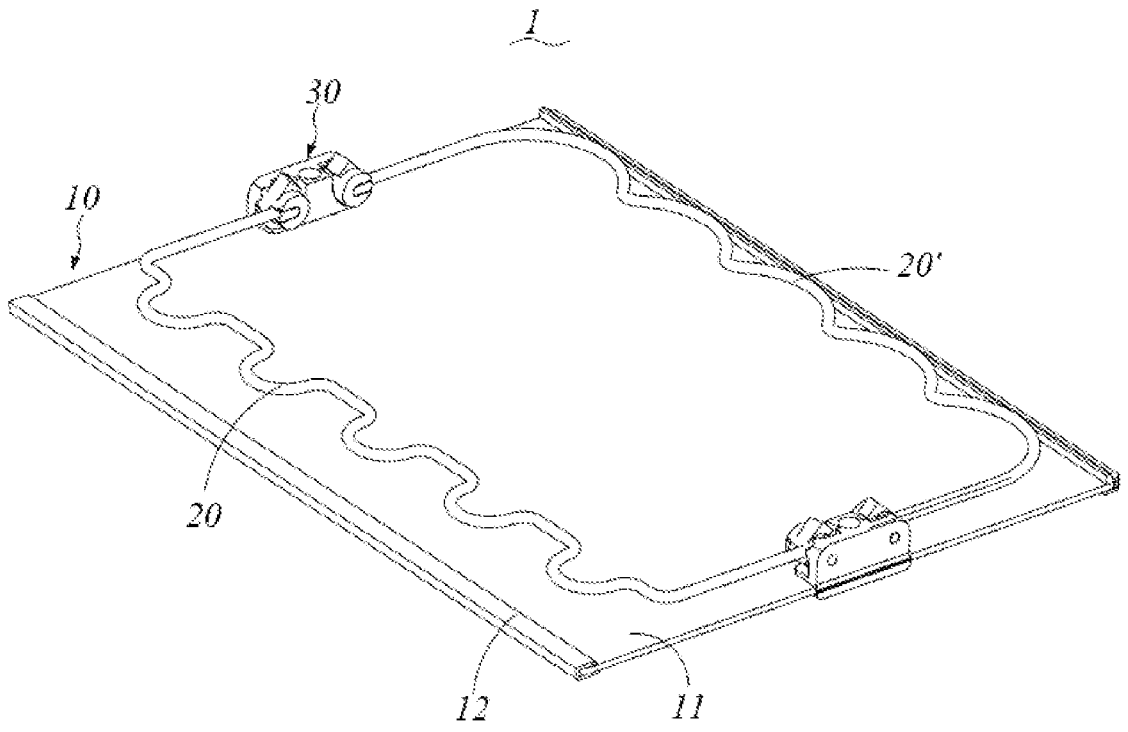
FIG. 1 is a schematic perspective diagram of a shelf in a folded state according to a preferred embodiment of the present invention.
Figure 2:
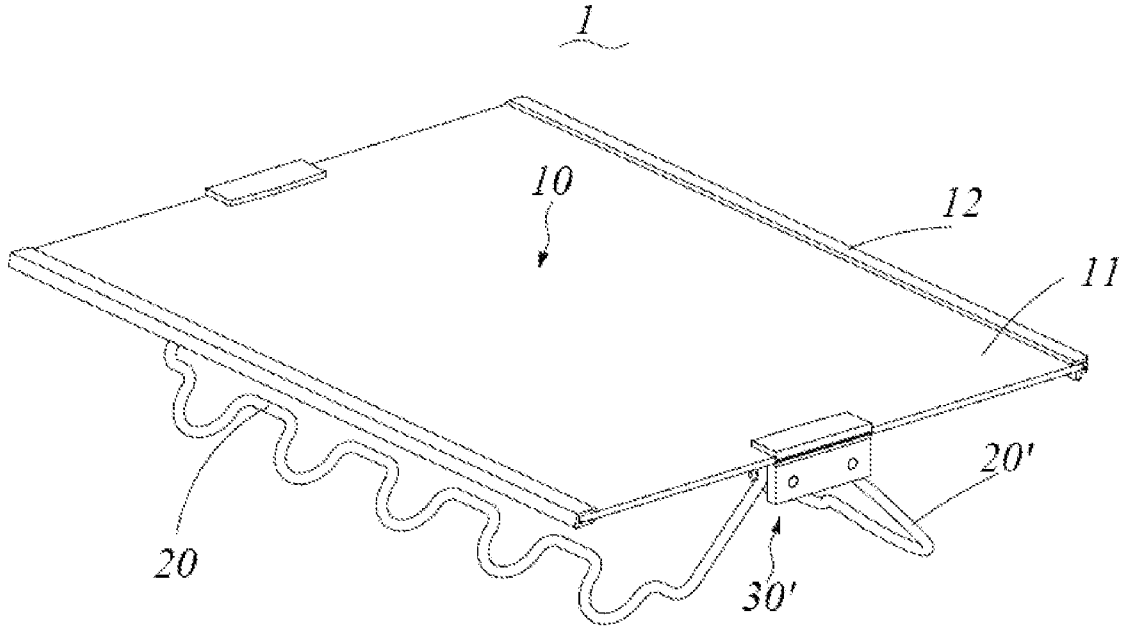
FIG. 2 is a schematic perspective diagram of the shelf shown in FIG. 1 in an unfolded state.

As shown in FIGS. 1 and 2, a preferable shelf 1 according to the present invention comprises a shelf plate 10 and wine racks (20, 20') connected to the shelf plate 10 pivotally and rotating between a folded position close to the shelf plate 10 and an unfolded position apart from the shelf plate 10. The shelf plate 10 comprises a panel 11 formed as a plane and a support 12 configured for supporting the panel 11. Generally, the panel 11 is made of a transparent material to transmit light, thereby saving electricity consumption of an illuminator in a storage space of a refrigerator. The support 12 is provided with a trim which covers a side edge of the panel 11 and is made of an elastic material to reduce vibration. In some special embodiments, the trim is made of an elastic transparent material, so as to further transmit light. The shelf 1 may be applied to the refrigerator, a limiting structure for receiving the shelf plate 10 is provided in a cabinet of the refrigerator, and the support 12 slides into the limiting structure to position the shelf plate 10.

As shown in FIGS. 1 and 2, a preferable shelf 1 according to the present invention comprises a shelf plate 10 and wine racks (20, 20') connected to the shelf plate 10 pivotally and rotating between a folded position close to the shelf plate 10 and an unfolded position apart from the shelf plate 10. The shelf plate 10 comprises a panel 11 formed as a plane and a support 12 configured for supporting the panel 11. Generally, the panel 11 is made of a transparent material to transmit light, thereby saving electricity consumption of an illuminator in a storage space of a refrigerator. The support 12 is provided with a trim (not shown) which covers a side edge of the panel 11 and is made of an elastic material to reduce vibration. In some special embodiments, the trim is made of an elastic transparent material, so as to further transmit light. The shelf may be applied to the refrigerator (not shown), a limiting structure for receiving the shelf plate 10 is provided in a cabinet of the refrigerator, and the support 12 slides into the limiting structure to position the shelf plate 10.

Figure 3:
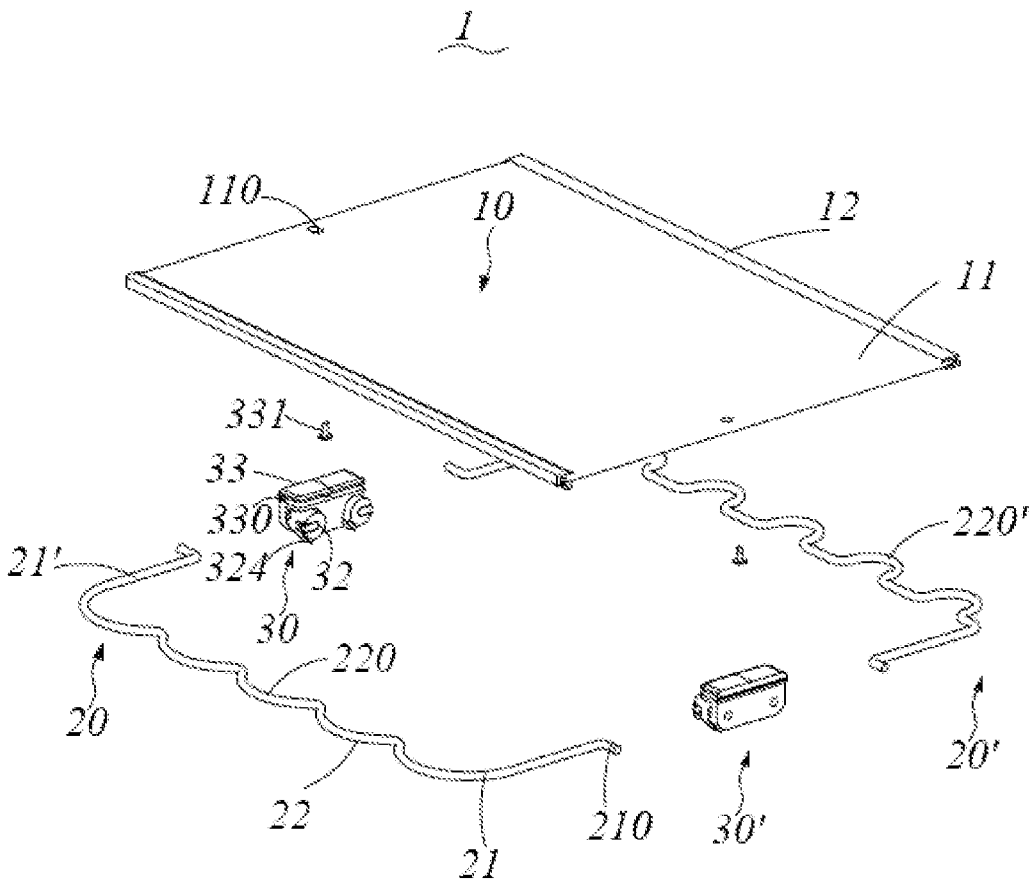
FIG. 3 is a schematic structural exploded diagram of the shelf shown in FIG. 1.

In a folded state shown in FIG. 1, the wine racks (20, 20') are located at the folded position close to the shelf plate 10, and in a usage state shown in FIG. 2, the wine racks (20, 20') are located at one of the unfolded positions apart from the shelf plate 10. In the present embodiment, the shelf 1 comprises the two wine racks (20, 20'), and since the two wine racks (20, 20') have the same relation of connection with the shelf plate 10, for convenience of description, description is made by taking one of the wine racks as an example. As shown in FIG. 3, the wine rack 20 comprises a middle portion 22 for laying a wine bottle and a connecting portion 21 for connecting the middle portion 22 to the shelf plate 10, and the wine rack 20 has two connecting portions (21, 21') which are connected to two ends of the middle portion 22 respectively. Certainly, in other embodiments, the shelf 1 may be provided with only one wine rack 20.

The shelf 1 further comprises rotary assemblies (30, 30') connected with the shelf plate 10 and the wine rack 20 and enabling the wine rack 20 to have at least two unfolded positions. The two rotary assemblies (30, 30') are connected with the two connecting portions (21, 21') of the wine rack 20 correspondingly. An existing wine rack 20 only has one folded position and one unfolded position, but the rotary assembly 30 in the embodiment of the present invention enables the wine rack 20 to have two unfolded positions, such that a user may regulate the unfolded position of the wine rack 20 according to actual needs, thereby meeting requirements of placing the wine bottles or beverage bottles of different sizes at different angles or heights.

Figure 4:
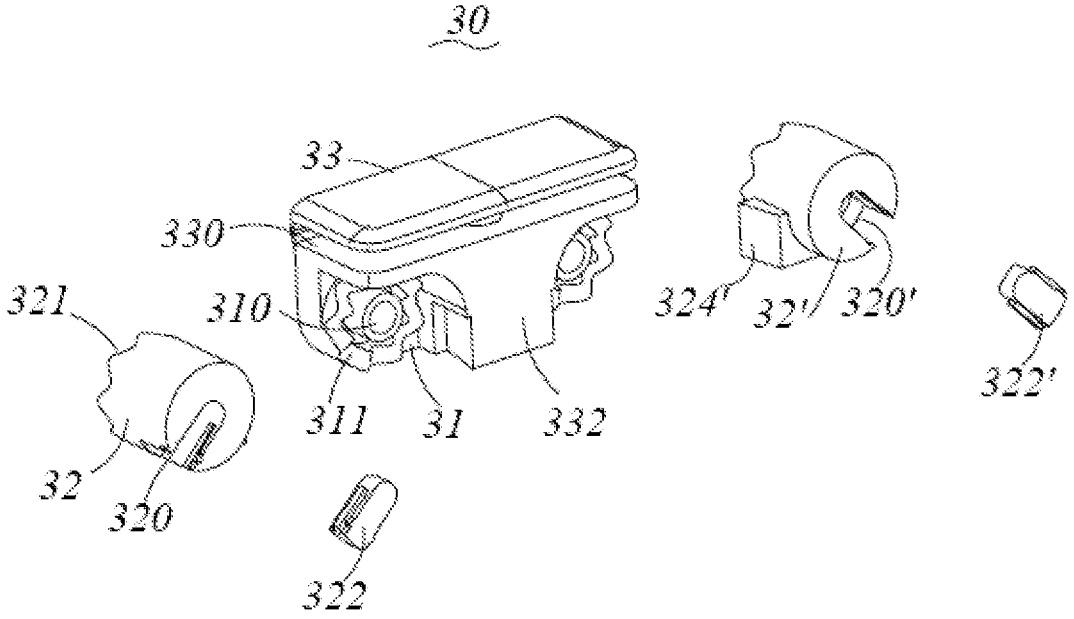
FIG. 4 is a schematic structural exploded diagram of a rotary assembly of the shelf shown in FIG. 3.

As shown in FIG. 4, the rotary assembly 30 comprises a first regulating part 31 connected with the shelf plate 10 and a second regulating part 32 connected with the wine rack 20, the first and second regulating parts 31, 32 are connected rotatably relative to each other around a pivotal shaft, and the folded position and the at least two unfolded positions are provided on one of the first and second regulating parts 31, 32 in a circumferential direction of the pivotal shaft.

The rotary assembly 30 further comprises a concave-convex engagement structure comprising a first curved surface 311 formed on the first regulating part 31 and a second curved surface 321 formed on the second regulating part 32, and when the first and second regulating parts 31, 32 are static relatively, the first curved surface 311 abuts against the second curved surface 321; when the second regulating part 32 rotates relative to the first regulating part 31, the second curved surface 321 jumps to and fro in an axial direction of the pivotal shaft by getting apart from and close to the first curved surface 311. With the concave-convex engagement structure, the first and second regulating parts 31, 32 may be clamped at a proper position as required when rotating relatively, and the operation is simple and easy, without occupying the space.

Specifically, one of the first and second curved surfaces 311, 321 is provided thereon with a groove and/or a projection, and the other of the first and second curved surfaces 311, 321 is provided thereon with a projection engaged with the groove and/or a groove engaged with the projection. In a preferred embodiment of the present invention, the first curved surface 311 is provided thereon with the groove and the projection, and the second curved surface 321 is provided thereon correspondingly with the projection and the groove which are engaged with the groove and the projection on the first curved surface 311. As such, each of the first and second curved surfaces 311, 321 appears as concave-convex curved surface with the projections and the grooves. The first and second curved surfaces 311, 321 are fitted with each other with a greater depth in an axial direction, thereby enabling the first regulating part 31 to be fitted with the second regulating part 32 more compactly and reliably.

Certainly, in a variant of the embodiment, a person skilled in the art may provide the groove on only one of the first and second curved surfaces 311, 321, for example, in a plane-groove-plane-groove form, and provide the projection on only the other, for example, in a plane-projection-plane-projection form. As such, jumped clamping may also be realized between the first and second regulating parts 31, 32.

In addition, a person skilled in the art may also readily conceive that in a variant of the embodiment, to realize selective limiting, only one of the first and second curved surfaces 311, 321 is provided thereon with several grooves, and the other of the first and second curved surfaces 311, 321 is provided thereon with one projection engaged with the grooves. The number of grooves may be determined by the number of fixed positions required actually, and the number of projections is not necessarily consistent with the number of grooves, and vice versa.

Referring to FIG. 4, the groove and the projection which are adjacent are connected smoothly to form a corrugated surface, N corrugated surfaces are provided on the first curved surface 311 and/or the second curved surface 321, and N is greater than three. With the groove and the projection which are connected smoothly, the first and second regulating parts 31, 32 rotate more smoothly and flexibly, thereby facilitating avoidance of vibration.

In the present embodiment, each of the first and second curved surfaces 311, 321 is provided with N corrugated surfaces uniformly, and N is eight. The first and second regulating parts 31, 32 may rotate by 360 degrees relative to each other, and with the eight corrugated surfaces, the second regulating part 32 rotates by 45 degrees relative to the first regulating part 31 every time jumping to and fro. Certainly, N may be greater, such that the number of angles at which the wine rack 20 is fixable is greater, and flexibility is higher. Certainly, N may also be a less natural number.

In the embodiments shown in FIGS. 3 and 4, the shelf 1 comprises the two wine racks (20, 20'), the same sides of which are connected with the shelf plate 10 through the same rotary assembly 30. The two wine racks (20, 20') are provided oppositely, with a limiting bump 332 provided therebetween to prevent the two wine racks (20, 20') from rotating to a position of collision. In such a rotary assembly 30, the angle by which each wine rack 20 may rotate ranges from 0-90 degrees. Thus, each wine rack 20 may have the folded position at the angle of 0 degree, the unfolded position at the angle of 45 degrees and the unfolded position at the angle of 90 degrees by providing three corrugated surfaces on each of opposite outer side surfaces of the two first curved surfaces 311 (and/or the second curved surfaces 321). Certainly, four corrugated surfaces may also be provided, and thus the wine rack 20 has three unfolded positions at which comprised angles of 30 degrees, 60 degrees and 90 degrees are formed with the shelf plate 10 respectively, and so on.

Referring to FIGS. 3 and 4, the rotary assembly 30 further comprises stoppers 324, 324' provided on one of the first and second regulating parts 31, 32, and when rotating by a certain angle relative to the first regulating part 31, the second regulating part 32 is blocked from rotating continuously by the stopper. In the present embodiment, the stoppers 324, 324' are provided on the second regulating parts 32, 32', and move between the folded position and the unfolded position relative to the first regulating part with the second regulating parts 32, 32', until stop surfaces of the stoppers 324, 324' abut against limiting surfaces of the first regulating parts 31, 31'. Certainly, in a variant of the embodiment, the stoppers may also be provided on the first regulating parts 31, 31', and the second regulating part is provided thereon with the corresponding limiting surface fitted with the stopper.

The rotary assembly 30 further comprises a reset part provided on one side of the first or second regulating part 31, 32, and when the second regulating part 32 rotates relative to the first regulating part 31, the reset part drives one of the first and second regulating parts 31, 32 to restore to abut against the other of the first and second regulating parts 31, 32, and the reset part and the pivotal shaft are provided on the same side of the first or second regulating part 31, 32. With the concave-convex engagement structure, the first and second regulating parts 31, 32 displace in the axial direction of the pivotal shaft while rotating relatively around the pivotal shaft, and the function of the reset part is to enable one of the first and second regulating parts 31, 32 to restore to abut against the other.

As mentioned before, the wine rack 20 comprises the middle portion 22 for laying the wine bottle and the connecting portion 21 for connecting the middle portion 22 to the shelf plate 10. In the present embodiment, the pivotal shaft is formed as a free end 210 of the connecting portion 21, and the reset part is configured as the connecting portion 21 which is bent and formed integrally relative to the middle portion 22. In the present embodiment, the wine rack 20 is configured as a steel-wire rack. As such, when the second regulating part 32 rotates around and apart from the first regulating part 31 axially, the two free ends 210 of the wine rack 20 get close to each other, and the connecting portion 21 is deformed by compression. However, the connecting portion 21 made of steel has a capacity of restoring elastic deformation, and driven by an elastic restoring force, the second regulating part 32 rotates continuously around the first regulating part 31, until the second and first regulating parts 32, 31 abut against with each other again.

The above is the embodiment in which the reset part is provided on one side of the second regulating part 32. Certainly, a person skilled in the art thus readily conceives that when the pivotal shaft is provided on one side of the first regulating part 31, the reset part may be configured as an elastic part provided at an end of the first regulating part 31.

As shown in FIG. 4, the second regulating parts (32, 32') are provided with open grooves (320, 320') for receiving the free ends. The second regulating parts 32, 32' further comprise fixing parts (322, 322') configured for sealing the open grooves (320, 320') after the free ends enter the open grooves (320, 320'), so as to avoid the free ends being separated from the open grooves (320, 320'). Further, limiting grooves may be provided on the open grooves (320, 320'), and the fixing parts (322, 322') are provided thereon with structures which are in sliding fit with the limiting grooves and limit unidirectionally. The limiting structure may be provided in an interference fit, and a person skilled in the art may also conceive many other embodiments which are not enumerated herein.

Referring to FIG. 4, the second regulating parts (32, 32') are connected with the free ends of the wine racks through the open grooves (320, 320') and the fixing parts (322, 322'), and the first regulating part 31 is provided with an accommodating groove 310 which receives the free end and is provided in a center of the first curved surface 311, such that the first and second regulating parts 31, 32 rotate around the free end.

As shown in FIGS. 3 and 4, the rotary assembly 30 further comprises a holder 33 for connecting the first regulating part 31 to the shelf plate 10. The holder 33 is provided therein with a slot 330 for accommodating a side edge of the shelf plate 10, and a through hole is provided at an edge of the slot 330. The rotary assembly 30 further comprises a fastener 331 which penetrates through the through hole and a mounting hole 110 provided on the shelf plate 10 successively. After the side edge of the shelf plate 10 enters the slot 330, the fastener 331 is mounted, thereby finishing mounting the first regulating part 31. Preferably, the fastener 331 is configured as a screw.

In the present embodiment, the wine rack 20 is provided thereon with an accommodating groove 220 for receiving a liquid container, and the accommodating groove 220 has the same size as a bottle body or a bottle neck of the container. The shelf 1 comprises the two wine racks 20, and the accommodating grooves 220 of the two wine racks (20, 20') have different sizes. As shown in FIG. 3, the wine rack 20 on the left side is defined as a front wine rack 20, and the wine rack 20' located on the right side is defined as a rear wine rack 20'. The accommodating groove 220' of the rear wine rack 20' has a smaller size than the accommodating groove 220 of the front wine rack 20, such that the bottleneck may also be placed on the rear wine rack 20', and the wine bottle is fixed more reliably. In addition, with the above-mentioned rotary assembly 30, the front wine racks 20 and the rear wine racks 20' are rotatably fixed at different unfolded positions, such that the bottle mouth of the wine bottle is higher than the bottle body, thus avoiding wine leak.

In conclusion, with the refrigerator and the shelf thereof according to the embodiments of the present invention, since the wine rack has plural unfolded positions relative to the shelf plate, the user may rotate the wine rack by plural angles repeatedly according to placement requirements, and regulate the angle and the height flexibly, thereby increasing practicability and improving the experience of the user.

It should be understood that although the present specification is described based on embodiments, not every embodiment contains only one independent technical solution. Such a narration way of the present specification is only for the sake of clarity. Those skilled in the art should take the present specification as an entirety. The technical solutions in the respective embodiments may be combined properly to form other embodiments which may be understood by those skilled in the art.

A series of the detailed descriptions set forth above is merely specific description of feasible embodiments of the present invention, and is not intended to limit the protection scope of the present invention. Equivalent embodiments or modifications made within the spirit of the present invention shall fall within the protection scope of the present invention.

What is claimed is:

1. A shelf, comprising a shelf plate and at least one rack connected to the shelf plate pivotally and rotating between a folded position adjacent to the shelf plate and an unfolded position apart from the shelf plate, wherein the shelf further comprises a rotary assembly connected with the shelf plate and the at least one rack and enabling the at least one rack to have at least two unfolded positions;

the rotary assembly comprises a first regulating part connected with the shelf plate and a second regulating part connected with the at least one rack, the first and second regulating parts are connected rotatably relative to each other around a pivotal shaft;

the rotary assembly further comprises a concave-convex engagement structure comprising a first curved surface formed on the first regulating part and a second curved surface formed on the second regulating part, and when the first and second regulating parts are static relatively, the first curved surface abuts against the second curved surface, when the second regulating part rotates relative to the first regulating part, the second curved surface jumps to and fro in an axial direction of the pivotal shaft by getting apart from and adjacent to the first curved surface;

the rotary assembly further comprises a reset part driving one of the first and second regulating parts to restore to abut against the other of the first and second regulating parts when the second regulating part rotates relative to the first regulating part;

the at least one rack comprises a middle portion for laying a bottle and a connecting portion for connecting the middle portion to the shelf plate, and the reset part is configured as the connecting portion.

2. The shelf according to claim 1, wherein the folded position and the at least two unfolded positions are provided on one of the first and second regulating parts in a circumferential direction of the pivotal shaft.

3. The shelf according to claim 1, wherein one of the first and second curved surfaces is provided thereon with a groove and/or a projection, and the other of the first and second curved surfaces is provided thereon with a projection engaged with the groove and/or a groove engaged with the projection.

4. The shelf according to claim 3, wherein the groove and the projection which are provided adjacently on the first curved surface and/or the second curved surface are connected smoothly to form a corrugated surface, N corrugated surfaces are provided on the first curved surface and/or the second curved surface, and N is not less than three.

5. The shelf according to claim 1, wherein the reset part provided on one side of the first or second regulating part, and the reset part and the pivotal shaft are provided on the same side of the first or second regulating part.

6. The shelf according to claim 1, wherein the pivotal shaft is formed as a free end of the connecting portion, and the connecting portion is bent and formed integrally relative to the middle portion.

7. The shelf according to claim 6, wherein the second regulating part is provided with open groove for receiving the free end, the second regulating part further comprises fixing part configured for sealing the open groove to prevent the free end from being separated from the open groove.

8. The shelf according to claim 7, wherein a limiting groove may be provided on the open groove, and the fixing part is provided with structure which is in sliding fit with the limiting groove and limit unidirectionally.

9. The shelf according to claim 7, wherein the first regulating part is provided with an accommodating groove which receives the free end, the first and second regulating parts rotate around the free end.

10. The shelf according to claim 1, wherein the rotary assembly further comprises a stopper provided on one of the first and second regulating parts, and when rotating by a certain angle relative to the first regulating part, the second regulating part is blocked from rotating continuously by the stopper.

11. The shelf according to claim 1, wherein the at least one rack is provided thereon with an accommodating groove for receiving a liquid container, the accommodating groove has the same size as a bottle body or a bottleneck of the container, and when the at least one rack of the shelf comprises two racks, the accommodating grooves of the two racks have respective sizes different from each other.

12. A refrigerator, comprising a cabinet, wherein the shelf according to claim 1 is provided in the cabinet.

13. The shelf according to claim 1, wherein the rotary assembly enables the rack to be rotatably fixed at each of the at least two unfolded positions.

* * * * *